US012799938B2

(12) United States Patent
Nagele

(10) Patent No.: US 12,799,938 B2
(45) Date of Patent: Nov. 17, 2026

(54) RADIAL PISTON PUMP

(71) Applicant: HAWE Hydraulik SE, Aschheim (DE)

(72) Inventor: Korbinian Nagele, Aschheim (DE)

(73) Assignee: HAWE Hydraulik SE, Aschheim (DE)

( * ) Notice: Subject to any disclaimer, the term of this patent is extended or adjusted under 35 U.S.C. 154(b) by 0 days.

(21) Appl. No.: 19/176,270

(22) Filed: Apr. 11, 2025

(65) Prior Publication Data

US 2025/0320868 A1 Oct. 16, 2025

(30) Foreign Application Priority Data

Apr. 15, 2024 (DE) ..... 10 2024 203 484.3

(51) Int. Cl.
*F04C 15/00* (2006.01)
*F04C 2/04* (2006.01)
*F04C 15/06* (2006.01)

(52) U.S. Cl.
CPC ..... *F04C 15/0065* (2013.01); *F04C 2/04* (2013.01); *F04C 15/06* (2013.01)

(58) Field of Classification Search
CPC ..... F04B 1/0404; F04B 1/053; F04B 9/045; F04B 11/0091; F04B 15/00; F04B 53/16; F04C 2/04; F04C 15/0065; F04C 15/006
See application file for complete search history.

(56) References Cited

U.S. PATENT DOCUMENTS

| | | | | |
|---|---|---|---|---|
| 5,547,348 A * | 8/1996 | Riley | F04B 1/0538 74/570.21 |
| 6,764,285 B1 * | 7/2004 | Kellner | F04B 1/0413 92/72 |
| 11,608,831 B2 * | 3/2023 | Koeppel | F04D 29/049 |
| 2012/0111185 A1 | 5/2012 | Stephenson | |
| 2024/0240627 A1 * | 7/2024 | Mueller | F04B 1/0421 |

FOREIGN PATENT DOCUMENTS

| | | |
|---|---|---|
| DE | 724497 | 8/1942 |
| DE | 2300569 A | 8/1973 |
| DE | 3003590 C2 | 8/1981 |
| DE | 102008036416 A1 | 2/2010 |
| SE | 2350633 A1 | 11/2024 |

* cited by examiner

*Primary Examiner* — Dapinder Singh
(74) *Attorney, Agent, or Firm* — Dinsmore & Shohl LLP

(57) ABSTRACT

A radial piston pump for conveying fluid under high pressure has a suction port, a pressure port and a plurality of pump elements for conveying the fluid under high pressure from the suction port to the pressure port. Furthermore, the radial piston pump includes a high-pressure-resistant suction line structure connecting the suction port to at least one suction inlet of each pump element.

13 Claims, 12 Drawing Sheets

RADIAL PISTON PUMP

CROSS REFERENCE TO RELATED APPLICATION

This application claims the priority benefit from German Patent Application No. 10 2024 203 484.3, filed on Apr. 15, 2024, the entire contents of which is incorporated herein by reference in its entirety.

FIELD

The present disclosure relates to a radial piston pump for conveying fluid under high pressure.

BACKGROUND

Radial piston pumps are well known and are used for pumping fluid at pressure-side loads of up to 1000 bar and more. Such radial piston pumps generally comprise a suction port, a pressure port, several pump elements, a pump shaft that defines a pump axis and an eccentric. Each pump element comprises at least one suction inlet and at least one pressure outlet. The pump shaft is configured to drive the pump elements via the eccentric in order to convey the fluid from the suction port to the pressure port. Furthermore, such a radial piston pump generally comprises a high-pressure-resistant pressure line structure that connects the pressure port to the at least one pressure outlet of each pump element.

The fluid is regularly delivered on the suction side from a tank or a housing reservoir of a pump unit in which the radial piston pump is used. At the suction port, the fluid to be pumped is sucked out of the tank or the housing reservoir by the radial piston pump. The fluid delivered by the radial piston pump is made available to a higher-level fluid system at the pressure port.

The fluid in the tank or housing reservoir is usually at approximately ambient pressure. Under certain circumstances, the tank or the housing reservoir can also be pre-loaded with a low pressure of up to 10 bar if the respective application requires this. However, conventional radial piston pumps that pump from a tank or housing reservoir are not suitable for suction-side pressures above 10 bar.

In new fields of application, such as the mobile refueling of vehicles with hydrogen from special tankers, there is an increasing number of applications in which a fluid to be pumped by a pump (suction side) is already under high pressure of up to 1000 bar.

SUMMARY

A radial piston pump for conveying fluid under high pressure is provided. The radial piston pump includes a suction port, a pressure port, a plurality of pump elements, a pump shaft which defines a pump axis; and an eccentric.

In one embodiment, each pump element includes at least one suction inlet and at least one pressure outlet and the pump shaft is configured to drive the pump elements via the eccentric in order to convey the fluid under high pressure from the suction port to the pressure port.

In one embodiment, the radial piston pump includes a high-pressure-resistant pressure line structure connecting the pressure port to the at least one pressure outlet of each pump element and a high-pressure-resistant suction line structure which connects the suction port to the at least one suction inlet of each pump element.

In one embodiment, the plurality of pump elements are disposed in at least two axial pump planes which differ from one another in their axial position in relation to the pump axis.

In one embodiment, the high-pressure-resistant suction line structure is at least partially formed by a separate piping arrangement.

In another embodiment, the high-pressure-resistant suction line structure is at least partially integrated into a housing of the radial piston pump.

In one embodiment, the high-pressure-resistant suction line structure includes at least one suction collecting section and at least one suction riser section. The at least one suction collecting section extends at least partially circumferentially with respect to the pump axis and the at least one suction riser section extends parallel to the pump axis.

In one embodiment, each pump element is disposed in a separate housing block.

In another embodiment, the plurality of pump elements are disposed in at least one annular casing block.

In one embodiment, the at least one suction collecting section is formed by a separate piping arrangement.

In another embodiment, the at least one suction collecting section is formed in at least one separate collecting plate.

In another embodiment, the at least one suction collecting section is integrated into at least one annular casing block.

In one embodiment, the at least one suction riser section is formed by a separate piping arrangement.

In another embodiment, the at least one suction riser section is integrated into at least one annular casing block. In one embodiment, the at least one annular casing block includes three suction riser sections in the form of suction through-holes and three suction collecting sections in the form of partially circumferential suction collecting grooves. Each suction through-hole opens into a suction collecting groove on one side and opens into an axial end face of the annular casing block on the other side.

In one embodiment, a mirror plane is defined by the pump axis and a suction riser section. The high-pressure-resistant suction line structure is mirror-symmetrical to the mirror plane.

In one embodiment, the plurality of pump elements do not include return elements.

In one embodiment, the pump shaft is disposed at least in sections in a housing chamber of the radial piston pump. The housing chamber is configured to be pressure-tight with respect to the environment and a cleaning fluid, which is different from the fluid to be conveyed and is accommodated in the housing chamber.

DETAILED DESCRIPTION

Figure 1:
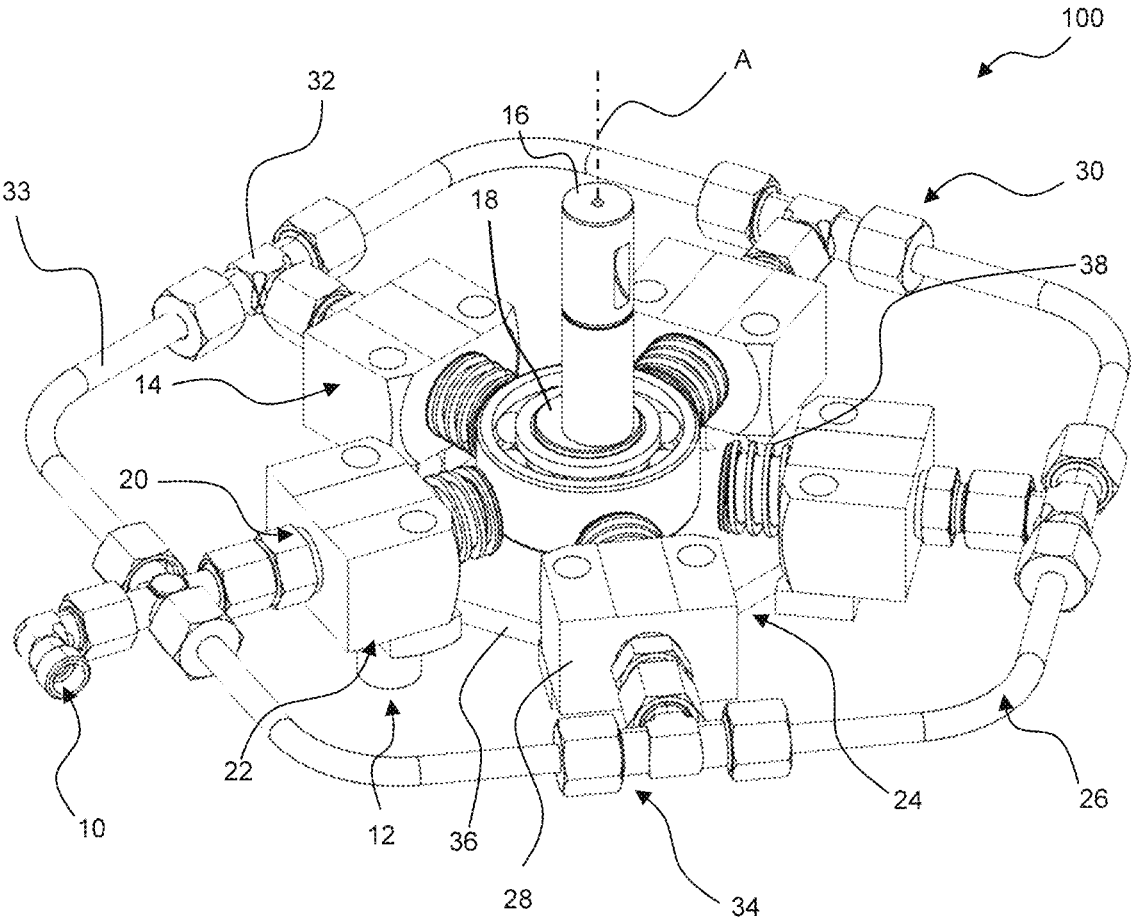
FIG. 1 is a perspective view of parts of a radial piston pump according to the disclosure in accordance with a first embodiment.

It is an objective of the present disclosure to provide a radial piston pump which is suitable for conveying fluid under high pressure.

The solution to this problem is achieved by a radial piston pump for conveying fluid under high pressure according to embodiments disclosed herein.

According to the disclosure, the radial piston pump for conveying fluid under high pressure comprises a high-pressure-resistant suction line structure which connects the suction port to the at least one suction inlet of each pump element.

For the purposes of the present disclosure, a fluid under high pressure is understood to be a fluid under a pressure of more than 10 bar and up to 1000 bar, more precisely between 20 bar and 1000 bar, even more precisely between 500 bar and 1000 bar. The delivery of a fluid under high pressure is understood here to mean that the fluid is already under high pressure on the suction side (and not only on the pressure side of the radial piston pump).

For the purposes of the present disclosure, a pump element is understood to mean the arrangement of at least one radial piston, a suction valve and a pressure valve for pumping fluid. Furthermore, a pump element can comprise a return element, for example in the form of a return spring, per radial piston.

In particular, the high-pressure-resistant suction line structure is configured such that it maintains a pressure of over 10 bar and up to 1000 bar, preferably between 20 bar and 1000 bar, more preferably between 500 bar and 1000 bar, between the suction port and the suction inlet of each pump element. For this purpose, the high-pressure-resistant suction line structure is formed in particular at least in sections as a separate piping arrangement, which is formed in particular from metal pipes and metal connecting pieces, or at least in sections as an arrangement of lines integrated into a metal block or a combination thereof.

The radial piston pump according to the disclosure is suitable for pumping fluids under high pressure.

In some aspects, the multiple pump elements are disposed in at least two axial pump planes, which differ from each other in their axial position in relation to the pump axis. This allows the achievable delivery volume of the radial piston pump to be increased in a compact arrangement.

In some aspects, the high-pressure-resistant suction line structure is at least partially formed by a separate piping arrangement. The separate piping arrangement is to be understood in particular as an arrangement of pipes that are separate from a housing of the radial piston pump. This allows the high-pressure-resistant suction line structure to be configured flexibly.

In some aspects, the high-pressure-resistant suction line structure is at least partially, preferably completely, integrated into a housing of the radial piston pump, preferably in the form of an internal line structure. For this purpose, the housing can be formed from a single housing block or several housing blocks. Due to the at least partial, preferably complete, integration of the high-pressure-resistant suction line structure into the housing of the radial piston pump, the radial piston pump can be configured to be particularly compact and space-efficient.

In some aspects, the high-pressure-resistant suction line structure comprises at least one suction collecting section and at least one suction riser section. The at least one suction collecting section extends at least partially circumferentially with respect to the pump axis and the at least one suction riser section extends parallel to the pump axis. This enables a modular extension of the radial piston pump with additional pump elements.

In one alternative, each pump element is disposed in a separate housing block. In other words, each pump element has its own housing block. Such pump elements for radial piston pumps are available as standard components that can be combined in any number. This increases flexibility and reduces the design effort when designing the radial piston pump.

In another alternative, the plurality of pump elements are disposed in at least one annular casing block. In other words: Several pump elements are disposed in each annular casing block of the radial piston pump. This enables a particularly compact and space-efficient design of the radial piston pump.

In one alternative, the at least one suction collecting section is formed by a separate piping arrangement. This enables a flexible design of the high-pressure-resistant suction line structure.

In a further alternative, the at least one suction collecting section is formed in at least one separate collecting plate. In particular, the radial piston pump comprises at least two annular casing blocks, with at least one separate collecting plate being disposed between two annular casing blocks. For the purposes of this application, a separate collecting plate is to be explicitly distinguished from a separate piping arrangement. A separate collecting plate makes it possible to arrange several lines in one plate, whereas in a separate piping arrangement several separate piping elements are connected to one another to form a separate piping arrangement. The use of a separate collecting plate enables a radially compact design of the high-pressure-resistant suction line structure.

In one alternative, the at least one suction riser section is formed by a separate piping arrangement. This enables a flexible design of the high-pressure-resistant suction line structure.

In another alternative, the at least one suction collecting section, in particular in the form of an at least partially circumferential suction collecting groove, is integrated into the at least one annular casing block. This enables a particularly compact and space-efficient design of the high-pressure-resistant suction line structure.

In a further alternative, the at least one suction riser section, in particular in the form of a suction through-hole, is integrated into the at least one annular casing block. This enables a particularly compact and space-efficient design of the high-pressure-resistant suction line structure and thus of the entire radial piston pump, especially if the at least one suction collecting section is also integrated into the at least one annular casing block.

In some aspects, each annular casing block includes three suction riser sections in the form of suction through-holes and three suction collecting sections in the form of partially circumferential suction collecting grooves, with each suction through-hole opening into a suction collecting groove on one side, in particular centrally in the circumferential direction, and opening into an axial end face of the annular casing block on the other side. This enables a particularly compact and space-efficient design of the high-pressure-resistant suction line structure and thus of the entire radial piston pump.

Furthermore, a mirror plane is preferably defined by the pump axis and a suction riser section, whereby the high-pressure-resistant suction line structure is mirror-symmetrical to the mirror plane. In particular, the high-pressure-resistant pressure line structure is also mirror-symmetrical to the mirror plane. This makes it easy to add additional pump elements to the radial piston pump in a modular manner in the direction of the pump axis in order to increase the achievable delivery volume of the radial piston pump.

In some aspects, the pump elements do not include any return elements. The fluid under high pressure on the suction side means that the radial piston pump according to the invention does not require return elements, such as return springs, since the fluid under high pressure on the suction side ensures the return of the radial pistons of the pump elements. As a result, the number of components required can be reduced, which lowers the manufacturing costs as well as the consumption of resources and the risk of failure of the radial piston pump.

In some aspects, the pump shaft is disposed at least in sections in a housing chamber of the radial piston pump, wherein the housing chamber is configured to be pressure-tight with respect to the environment and a cleaning fluid, which is different from the fluid to be conveyed and is preferably pre-loaded with respect to the ambient pressure, is accommodated in the housing chamber. Further preferably, the radial piston pump comprises a cleaning fluid inlet for introducing the cleaning fluid into the housing chamber and a cleaning fluid outlet for discharging the cleaning fluid from the housing chamber. In particular, the cleaning fluid is pressurized against the ambient pressure, for example to 2 to 3 bar. This allows the cleaning fluid to be replaced during operation of the radial piston pump. Any leaks of the fluid to be pumped into the housing chamber can be absorbed by the cleaning fluid and discharged via the cleaning fluid outlet. In this way, the components in the housing (for example the pump shaft, the eccentric, the eccentric bearings and other components) can be protected from any harmful effects of the fluid to be pumped.

The radial piston pump configured according to the disclosure for conveying fluid under high pressure can work particularly energy-efficiently, as it only has to raise the pressure of the conveyed fluid by the pressure difference between the high-pressure suction side and the pressure side. Furthermore, the radial piston pump according to the disclosure avoids the formation of cavitations in the suction process. In addition, the radial piston pump according to the disclosure can reduce the suction force of the radial pistons of the pump elements and thus prevent the radial pistons from lifting off the eccentric, so that the radial piston pump can be operated at significantly higher speeds without increased wear.

Figure 2:
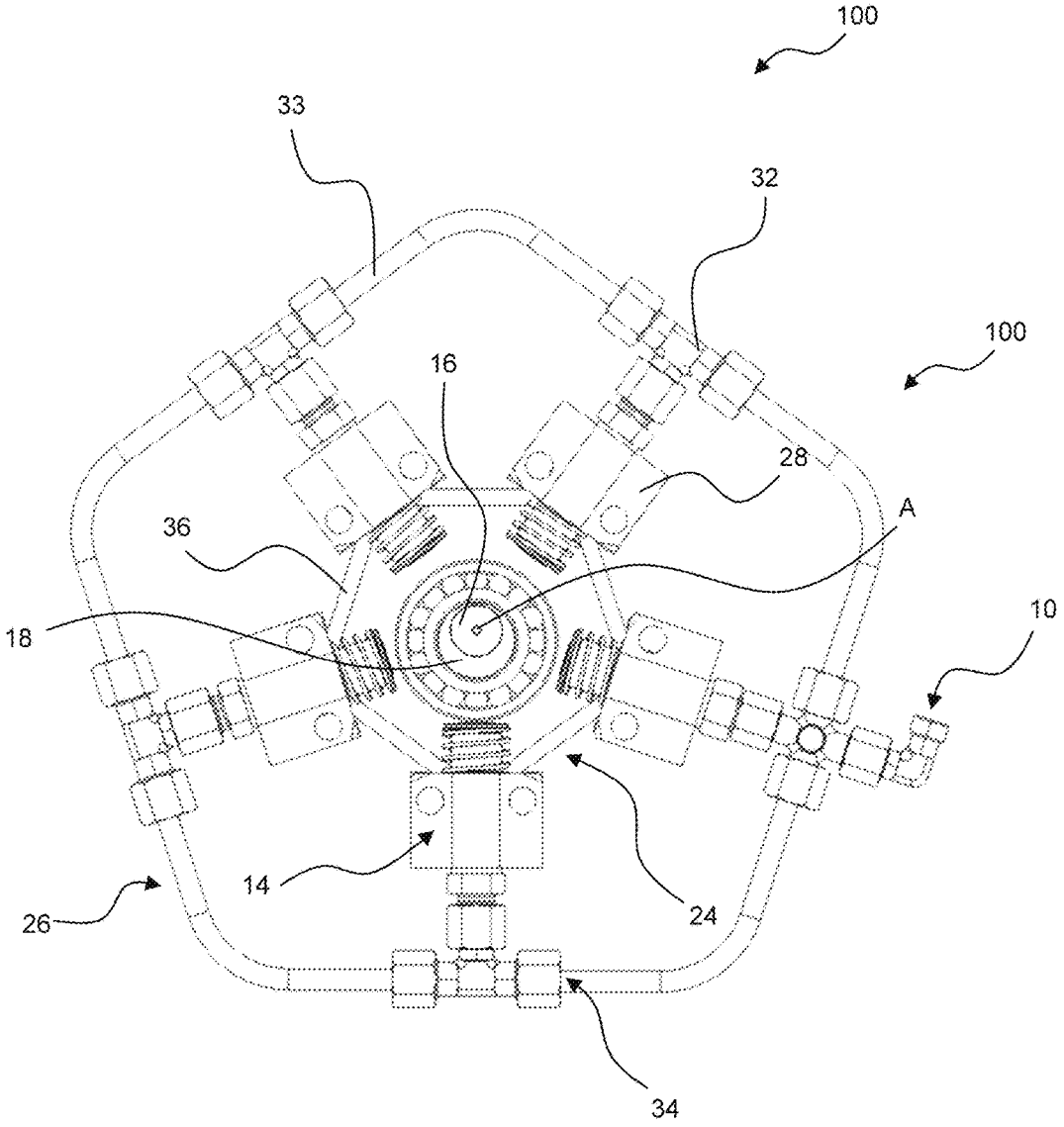
FIG. 2 is a top view of the radial piston pump from FIG. 1.

FIGS. 1 and 2 show a radial piston pump 100 for conveying fluid under high pressure according to a first embodiment of the present disclosure.

The radial piston pump 100 comprises a suction port 10, a pressure port 12, a plurality of pump elements 14, a pump shaft 16 defining a pump axis A, and an eccentric 18. The radial piston pump 100 shown in FIGS. 1 and 2 comprises five pump elements 14. Each pump element 14 comprises a suction inlet 20 and a pressure outlet 22. The pump shaft 16 is configured to drive the pump elements 14 via the eccentric 18 to deliver the fluid under high pressure from the suction port 10 to the pressure port 12. The radial piston pump 100 comprises a high-pressure resistant pressure line structure 24, which connects the pressure port 12 to the pressure outlet 22 of each pump element 14.

The radial piston pump 100 further comprises a high pressure resistant suction line structure 26 connecting the suction port 10 to the suction inlet 20 of each pump element 14.

As shown in FIGS. 1 and 2, the pump elements 14 of the radial piston pump 100 are each disposed in a separate housing block 28.

As can be seen in FIGS. 1 and 2, the high-pressure-resistant suction line structure 26 of the radial piston pump 100 is formed by a separate piping arrangement 30. For this purpose, T-pieces 32 are mounted on the suction inlets 20 of the pump elements 14, which in turn are connected to each other in the circumferential direction via pipe sections 33. Thus, the separate piping arrangement 30 forms a suction collecting section 34 of the high-pressure-resistant suction line structure 26, which extends completely circumferentially with respect to the pump axis A. As a result, the suction collecting section 34 of the high-pressure-resistant suction line structure 26 connects all suction inlets 20 of the pump elements 14 to each other and to the suction port 10 of the radial piston pump 100.

The high-pressure resistant pressure line structure 24 of the first embodiment is configured as a separate pressure collecting arrangement 36, which connects all pressure outlets 22 of the pump elements 14 to each other and to the pressure port 12 of the radial piston pump 100.

As can be seen in FIGS. 1 and 2, the pump elements 14 are arranged in an axial pump plane in relation to the pump axis A.

In this embodiment, the pump elements 14 also comprise return elements in the form of return springs 38. Since the fluid conveyed by the radial piston pump 100 is under high pressure of more than 10 bar, preferably between 20 bar and 1000 bar, more preferably between 500 bar and 1000 bar, at the suction port 10, the return springs 38 may also be omitted.

Figure 3:
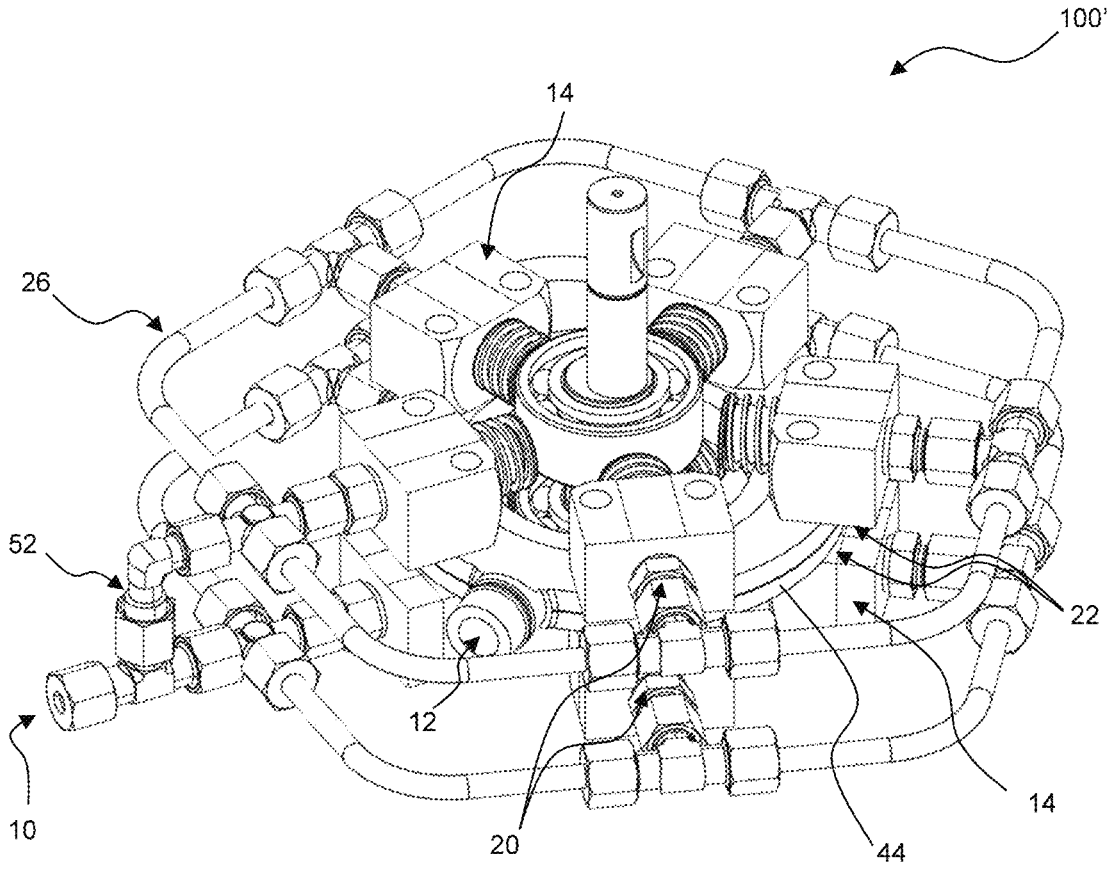
FIG. 3 is a perspective view of a radial piston pump according to the disclosure in accordance with a variant of the first embodiment.
Figure 4:
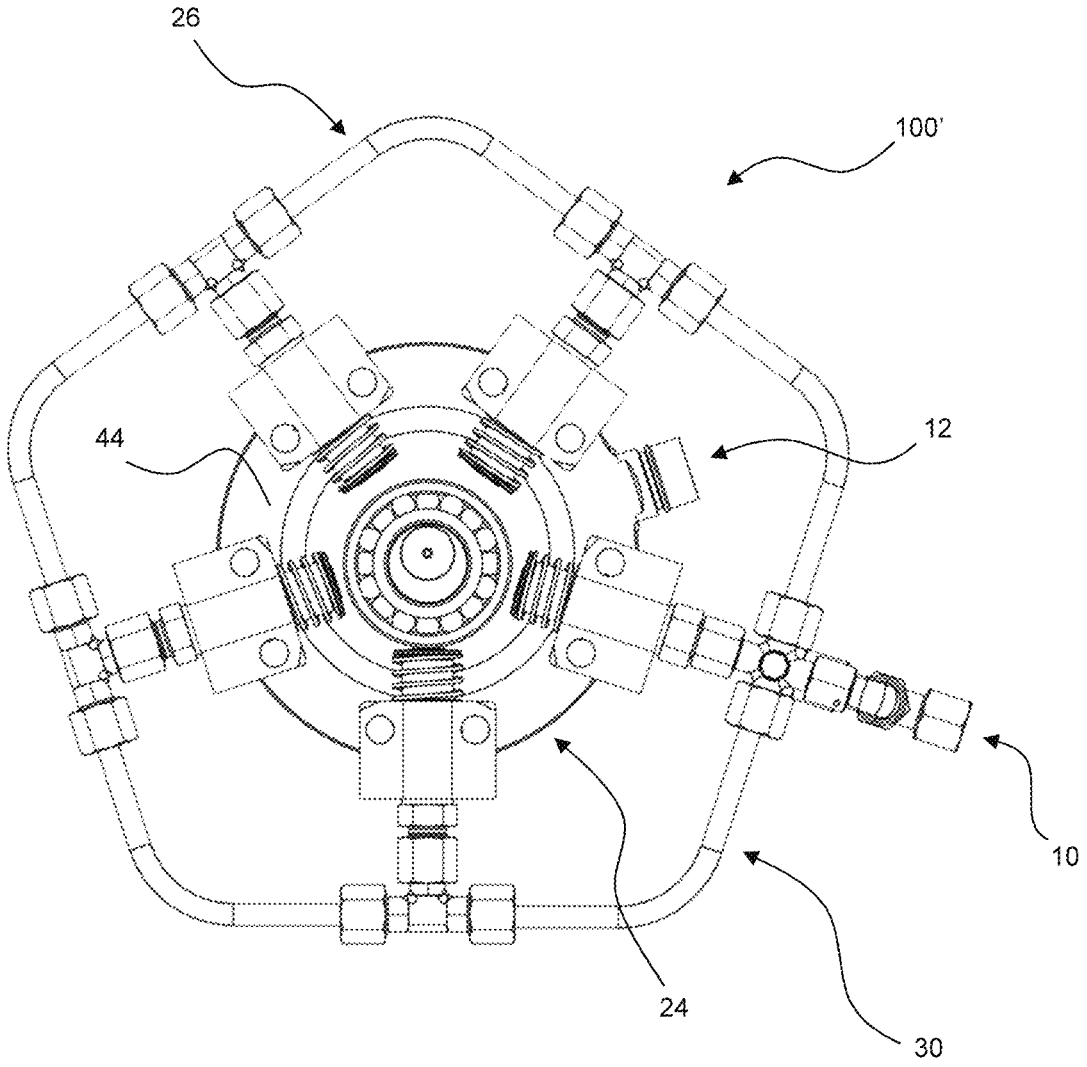
FIG. 4 is a top view of the radial piston pump from FIG. 3.

FIGS. 3 and 4 show a radial piston pump 100' according to a variant of the first embodiment which, compared to the radial piston pump 100, comprises five further pump elements 14 which are disposed in a second axial pump plane in relation to the pump axis A. The second axial pump plane differs in its axial position in relation to the pump axis A from the axial pump plane shown in FIG. 1. As can be seen in FIG. 3, the second axial pump plane is arranged below the axial pump plane shown in FIG. 1 in the axial direction of the pump axis A with respect to FIG. 3.

In this variant of the first embodiment, the high-pressure-resistant pressure line structure 24 is formed by a pressure collecting plate 44 instead of by the separate pressure collecting arrangement 36, which connects the pressure outlets 22 of all ten pump elements 14 to each other and to the pressure port 12. In addition, unlike the radial piston pump 100 of FIGS. 1 and 2, the separate piping arrangement 30 of the radial piston pump 100' comprises a suction riser section 52, so that the high-pressure-resistant suction line structure 26 connects all ten suction inlets 20 of the pump elements 14 to each other and to the suction port 10 of the radial piston pump 100'.

Figure 5:
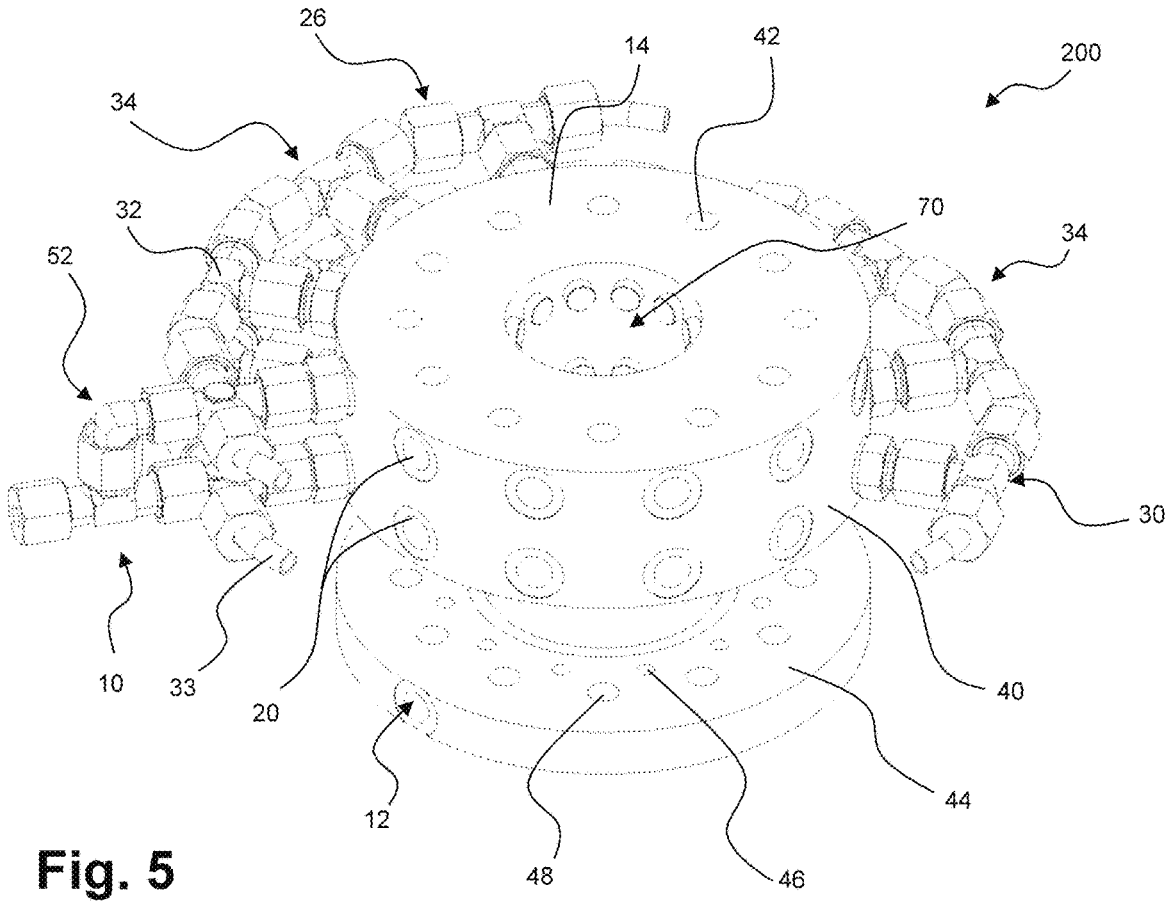
FIG. 5 is an exploded perspective view of a radial piston pump according to the disclosure in accordance with a second embodiment.
Figure 6:
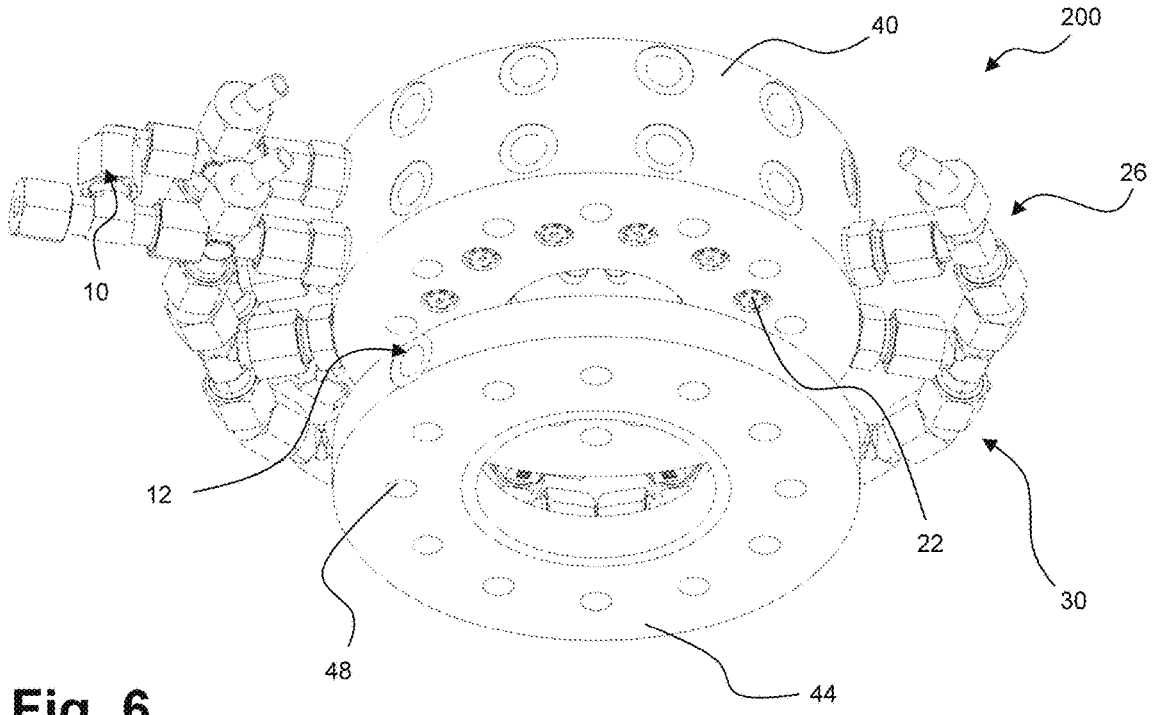
FIG. 6 is another perspective view of the radial piston pump from FIG. 5.

FIGS. 5 and 6 show a radial piston pump 200 according to a second embodiment of the present disclosure. For the sake of clarity, only those elements of the radial piston pump 200 are shown which are necessary for explanation. For example, the pump shaft 16 and the eccentric 18 are not shown in FIGS. 5 and 6.

The radial piston pump 200 according to the second embodiment comprises a annular casing block 40, in which twelve pump elements 14 are disposed in an axial pump plane. The pump elements 14 of the radial piston pump 200 each comprise two suction inlets 20 and one pressure outlet 22 (see FIG. 6). In this embodiment, the annular casing block 40 also comprises twelve mounting holes 42.

As can be seen in FIGS. 5 and 6, the radial piston pump 200 also comprises a pressure collecting plate 44 with twelve pressure inlets 46 and twelve mounting holes 48, which correspond to the pressure outlets 22 of the pump elements 14 and the mounting holes 42 of the annular casing block 40. The pressure port 12 of the radial piston pump 200 is formed in the pressure collecting plate 44. Inside the pressure collecting plate 44, all pressure inlets 46 are connected to the pressure port 12. In the assembled state of the radial piston pump 200, when the pressure collecting plate 44 is attached to the annular casing block 40, the pressure outlets 22 of the pump elements 14 are connected to the pressure inlets 46 of the pressure collecting plate 44 in a fluid-tight manner. The pressure collecting plate 44 thus forms the high-pressure-resistant pressure line structure 24 of the radial piston pump 200.

In a similar manner to the first embodiment of FIGS. 1 to 4, the high-pressure-resistant suction line structure 26 of the radial piston pump 200 of the second embodiment is formed by a separate piping arrangement 30. The two fully circumferential suction collecting sections 34 of the high-pressure-resistant suction line structure 26 of the radial piston pump 200, partially shown in FIGS. 5 and 6, are connected to one another via a suction riser section 52 of the high-pressure-resistant suction line structure 26 of the radial piston pump 200, so that all suction inlets 20 of the pump elements 14 are connected to the suction port 10 in a fluid-tight manner.

Figure 7:
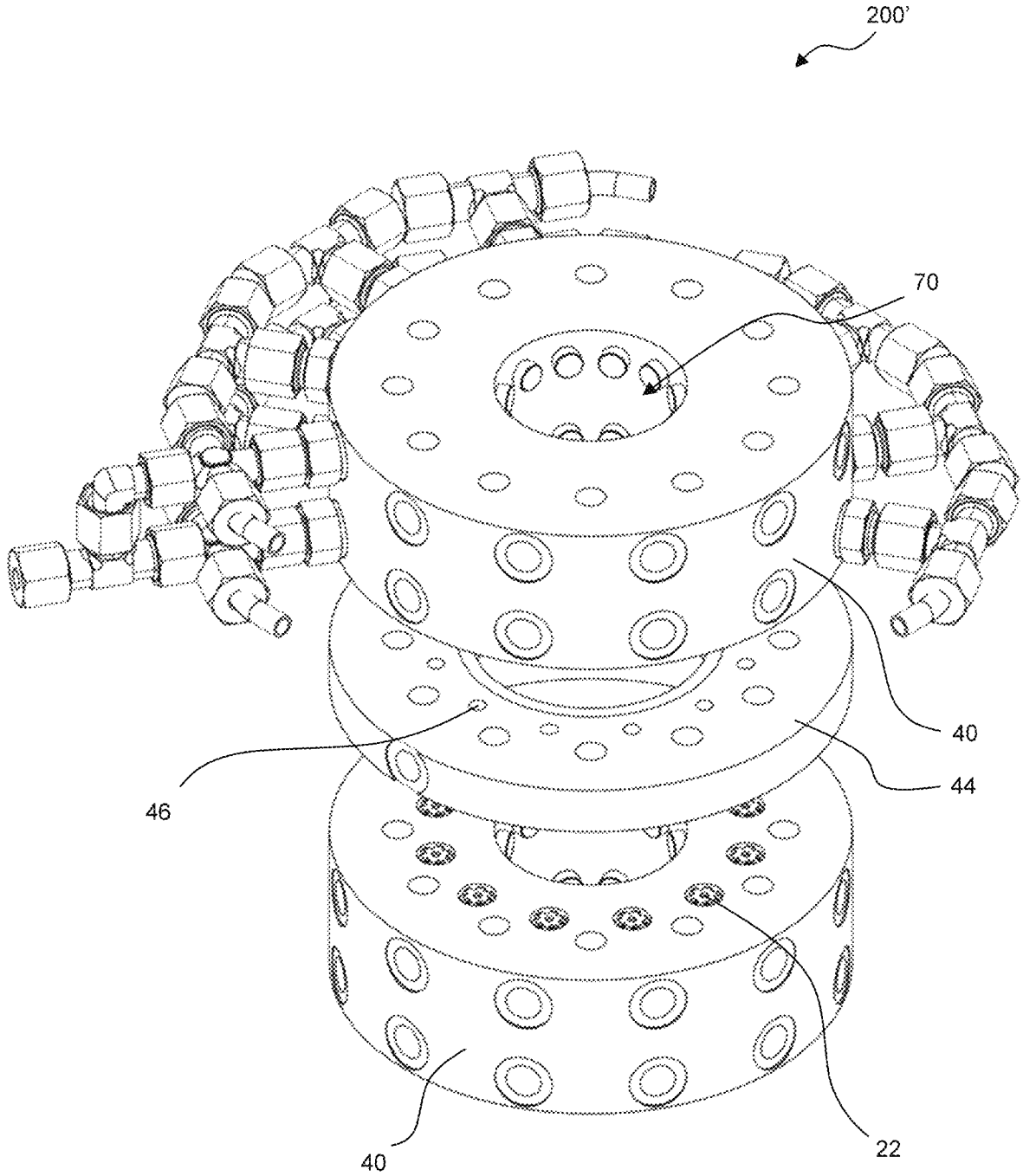
FIG. 7 is an exploded perspective view of a radial piston pump according to the disclosure in accordance with a variant of the second embodiment.

In a variant of the second embodiment, which can be seen in FIG. 7, the radial piston pump 200' comprises a second annular casing block 40, which is disposed in a second axial pump plane. Here, the second annular casing block 40 is disposed below the pressure collecting plate 44. The pressure inlets 46 of the pressure collecting plate 44 are configured such that they extend axially through the pressure collecting plate 44. As a result, the pressure outlets 22 of the pump elements 14 of the annular casing blocks 40 disposed in the two axial pump planes can be connected axially from both sides to the pressure port 12 via the pressure collecting plate 44. In this case, the high-pressure-resistant suction line structure 26 comprises at least one further suction riser section in order to also connect the suction port 10 to all suction inlets 20 of the pump elements 14 disposed in the second axial pump plane in a fluid-conducting manner.

It is also conceivable that the radial piston pump 200' comprises more than two annular casing blocks 40 in total. In this case, the radial piston pump 200' also comprises more than one pressure collecting plate 44, in which case the pressure collecting plates 44 are additionally connected by a separate piping arrangement which forms at least one pressure riser section of the high-pressure resistant pressure line structure 24, as shown for example in FIG. 8 for the third embodiment, in order to connect all pressure outlets 22 of the pump elements 14 to the pressure port 12 of the radial piston pump 200.

Figure 8:
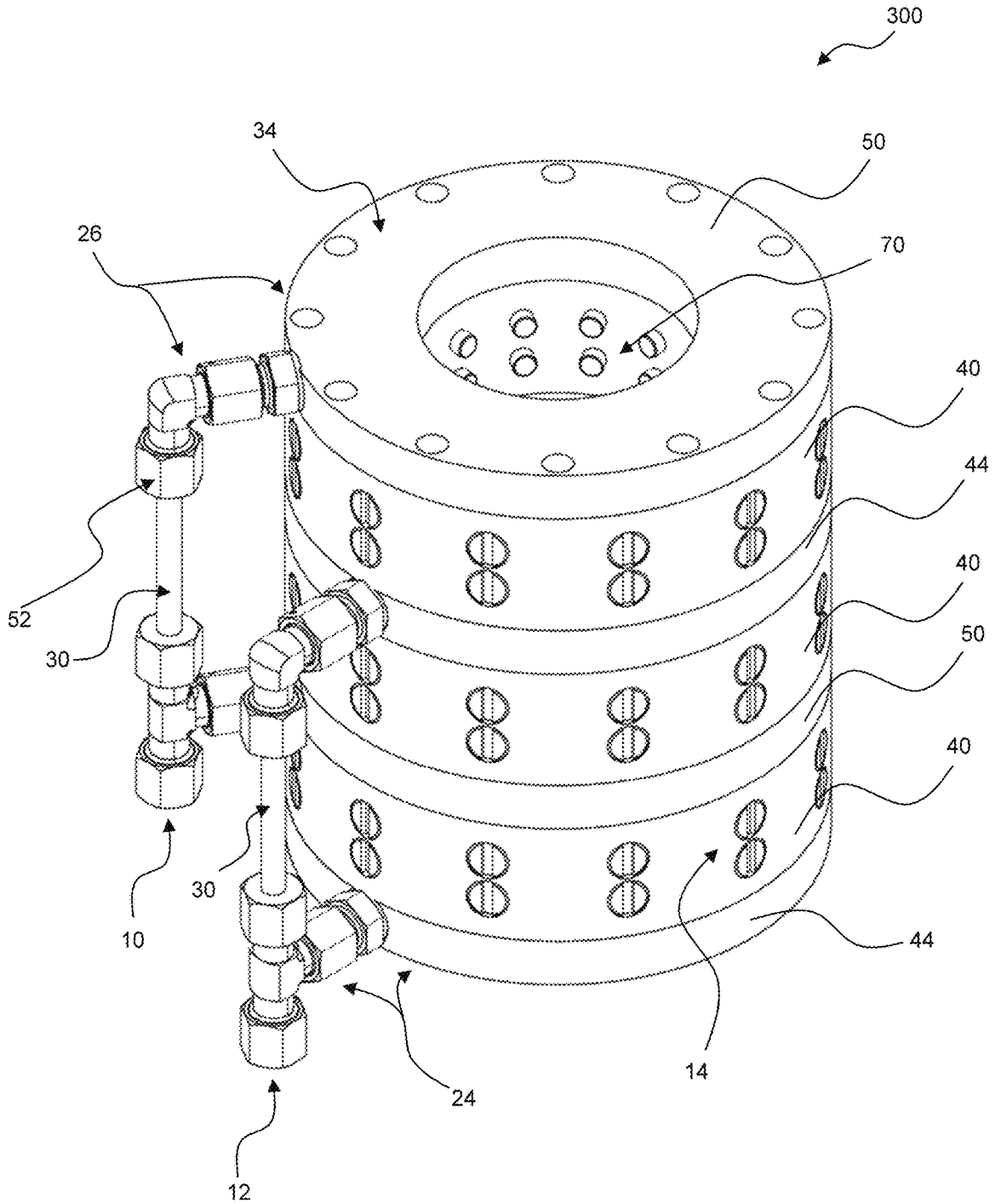
FIG. 8 is a perspective view of a radial piston pump according to the disclosure according to a third embodiment.
Figure 9:
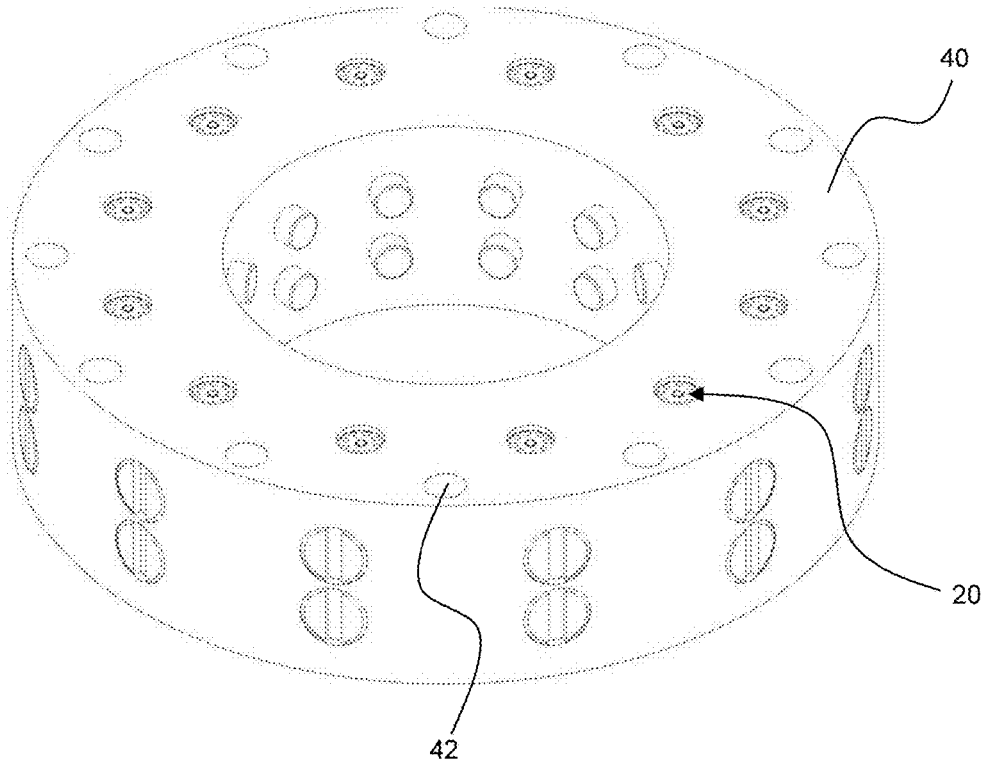
FIG. 9 is a perspective view of a annular casing block of the radial piston pump from FIG. 8.
Figure 10:
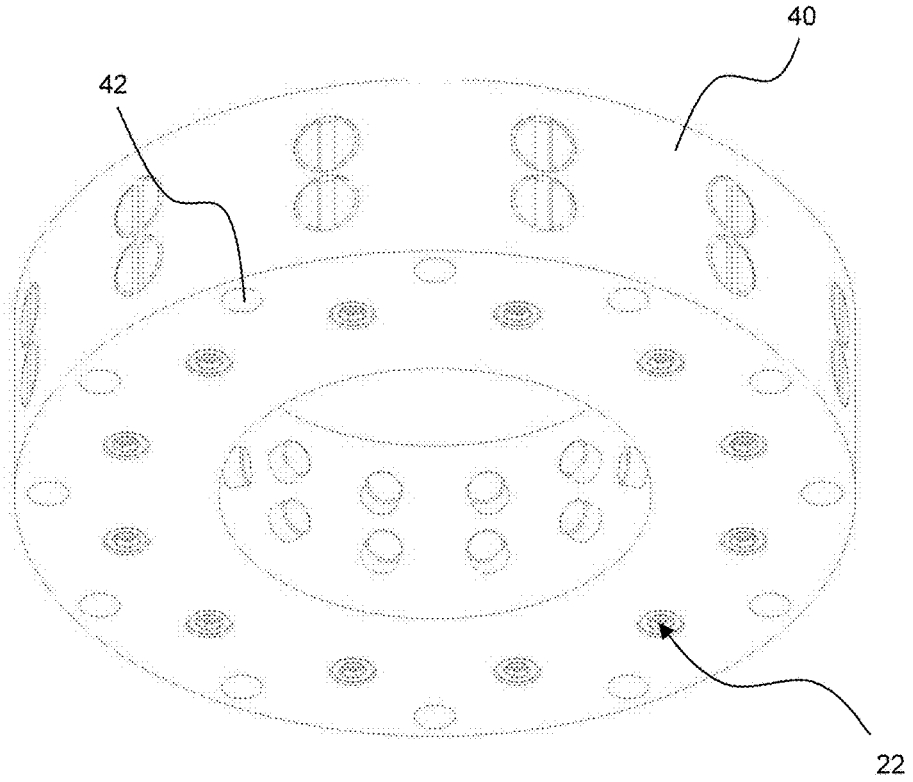
FIG. 10 is another perspective view of the annular casing block from FIG. 9.

FIGS. 8 to 10 show a radial piston pump 300 according to a third embodiment of the present disclosure. For the sake of clarity, only those elements of the radial piston pump 300 are shown which are necessary for explanation.

The radial piston pump 300 comprises three annular casing blocks 40, two pressure collecting plates 44 and two suction collecting plates 50.

The suction collecting plates 50 form the suction collecting sections 34 of the high-pressure-resistant suction line structure 26 of the radial piston pump 300. A separate piping arrangement 30 forms a suction riser section 52 of the high-pressure-resistant suction line structure. The suction riser section 52 connects the suction collecting plates 50 to each other and to the suction port 10 of the radial piston pump 300. Thus, the high-pressure resistant suction line structure 26 connects the suction inlets 20 of all pump elements 14 to the suction port 10 of the radial piston pump 300.

Similarly, a separate piping arrangement 30 forms a pressure riser section of the high-pressure resistant pressure line structure 24 of the radial piston pump 300, which connects the two pressure collecting plates 44 to each other and to the pressure port 12. Thus, the high-pressure-resistant pressure line structure 24 connects the pressure outlets 22 of all pump elements 14 with the pressure port 12 of the radial piston pump 300.

In the annular casing blocks 40 of the radial piston pump 300, both the suction inlets 20 (see FIG. 9) and the pressure outlets 22 (see FIG. 10) of the pump elements 14 are aligned parallel to the pump axis A.

For experts in the field of radial piston pumps, it will be clear that the radial piston pump 300 can also comprise more or less than three annular casing blocks 40 and a corresponding number of pressure collecting plates 44 or suction collecting plates 50, depending on the requirement profile. The same applies analogously to the first and second embodiments and the fourth embodiment described below.

FIGS. 11 to 16 show a radial piston pump 400 according to a fourth embodiment.

In the radial piston pump 400, both the high-pressure-resistant suction line structure 26 and the high-pressure-resistant pressure line structure 24 are fully integrated into the housing of the radial piston pump 400.

Figure 16:
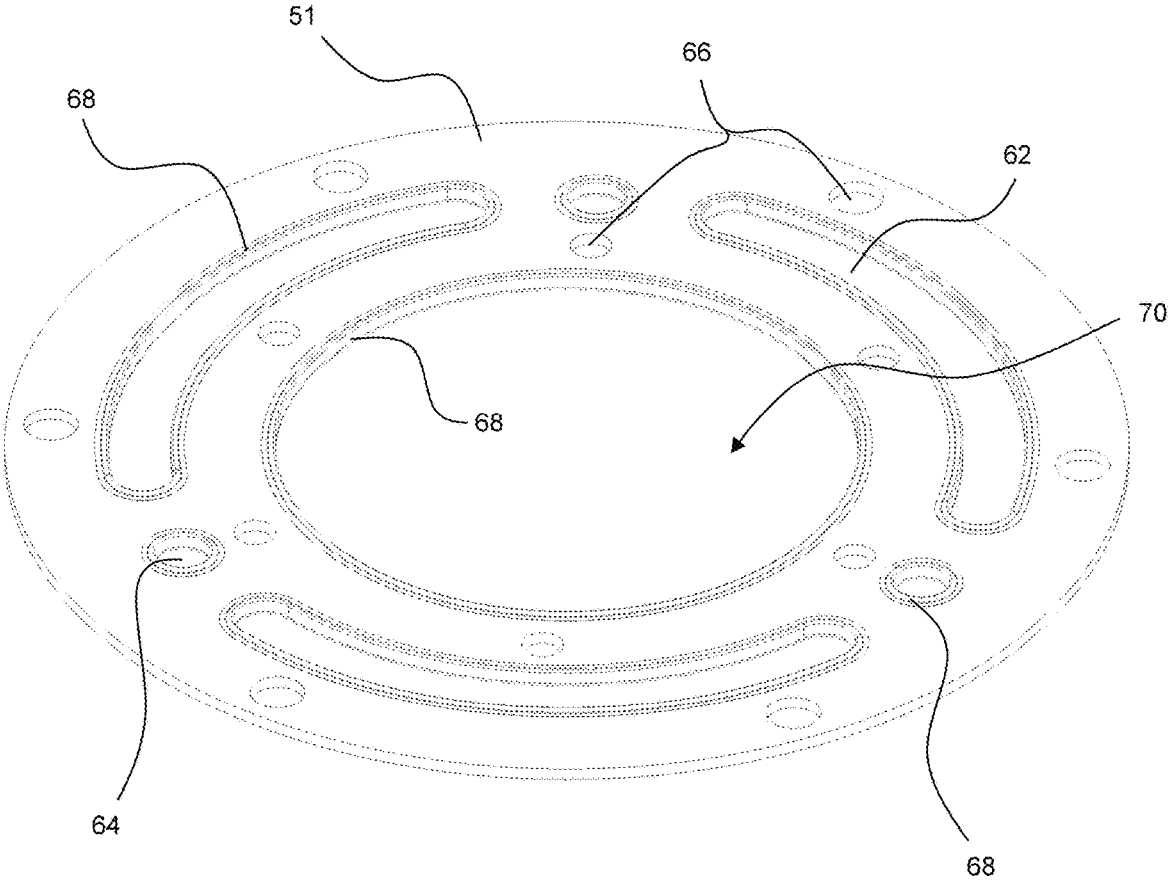
FIG. 16 is a perspective view of a sealing plate of the radial piston pump from FIG. 11.

The housing of the radial piston pump 400 is formed by five annular casing blocks 40, a pressure collecting plate 44 and a suction collecting plate 50. A sealing plate 51, shown in detail in FIG. 16, is disposed between each two annular casing blocks 40. The five annular casing blocks 40 are arranged in five axial pump planes in relation to the pump axis A.

FIGS. 12 to 15 illustrate an internal line structure 53 of the annular casing blocks 40 of the radial piston pump 400.

Figure 12:
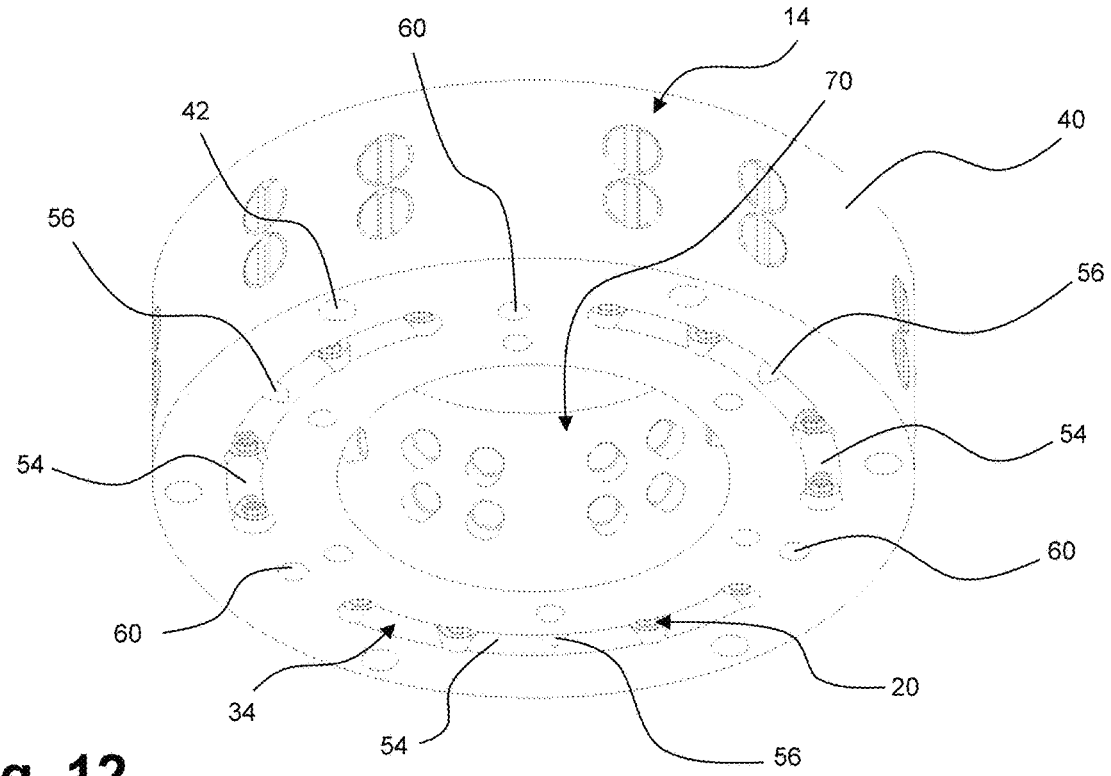
FIG. 12 is perspective view of an annular casing block of the radial piston pump from FIG. 11.
Figure 13:
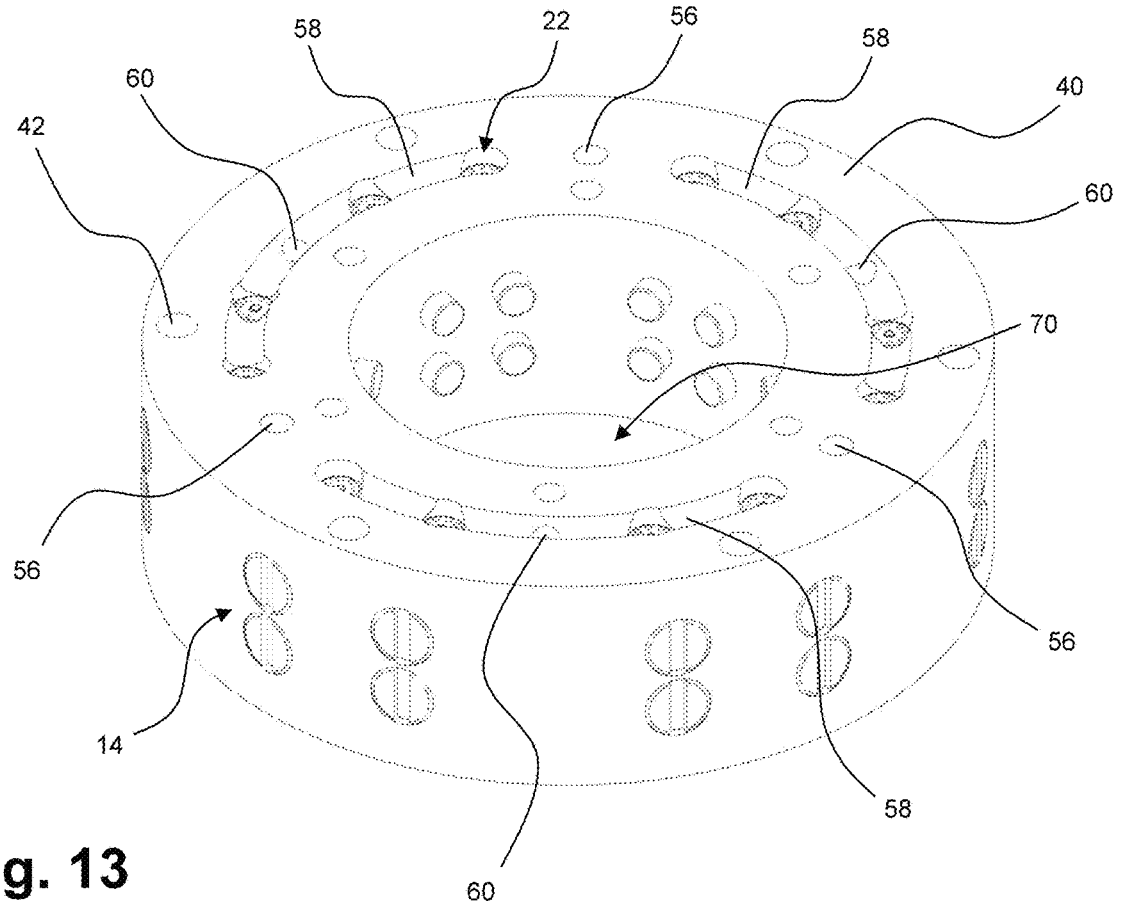
FIG. 13 is another perspective view of the annular casing block from FIG. 12.
Figure 14:
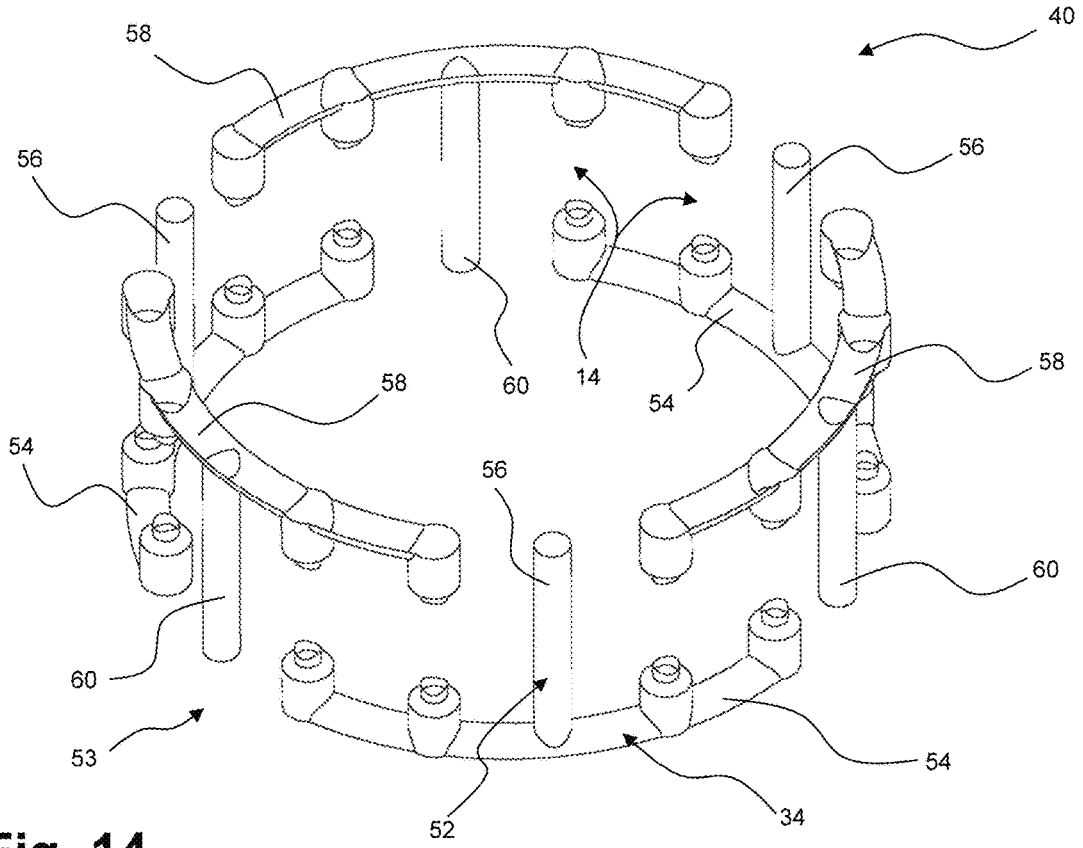
FIG. 14 is a perspective view of the line structures inside the annular casing block from FIG. 12.

As can be seen in FIGS. 12 to 14, the high-pressure-resistant suction line structure 26 of the radial piston pump 400 in an annular casing block 40 comprises three partially circumferential suction collecting sections 34 in the form of partially circumferential suction collecting grooves 54. Furthermore, the high-pressure-resistant suction line structure 26 of the radial piston pump 400 in an annular casing block 40 comprises three suction riser sections 52 in the form of suction through-holes 56. Each suction through-hole 56 opens on one side into a suction collecting groove 54 (see FIG. 12) and on the other side into an axial end face of the annular casing block 40 (see FIG. 13). More precisely, each suction through-hole 56 opens centrally into a suction collecting groove 54 when viewed in the circumferential direction of the pump axis A.

Similarly, the high-pressure resistant pressure line structure 24 of the radial piston pump 400 in an annular casing block 40 comprises three partially circumferential pressure collecting sections in the form of partially circumferential pressure collecting grooves 58. Furthermore, the high-pressure resistant pressure line structure 24 of the radial piston pump 400 in an annular casing block 40 comprises three pressure riser sections in the form of pressure through-holes 60. Each pressure through-hole 60 opens on one side into a pressure collecting groove 58 (see FIG. 13) and on the other side into an axial end face of the annular casing block 40 (see FIG. 12). More precisely, each pressure through-hole 60 opens centrally into a pressure collecting groove 58 when viewed in the circumferential direction of the pump axis A.

Figure 15:
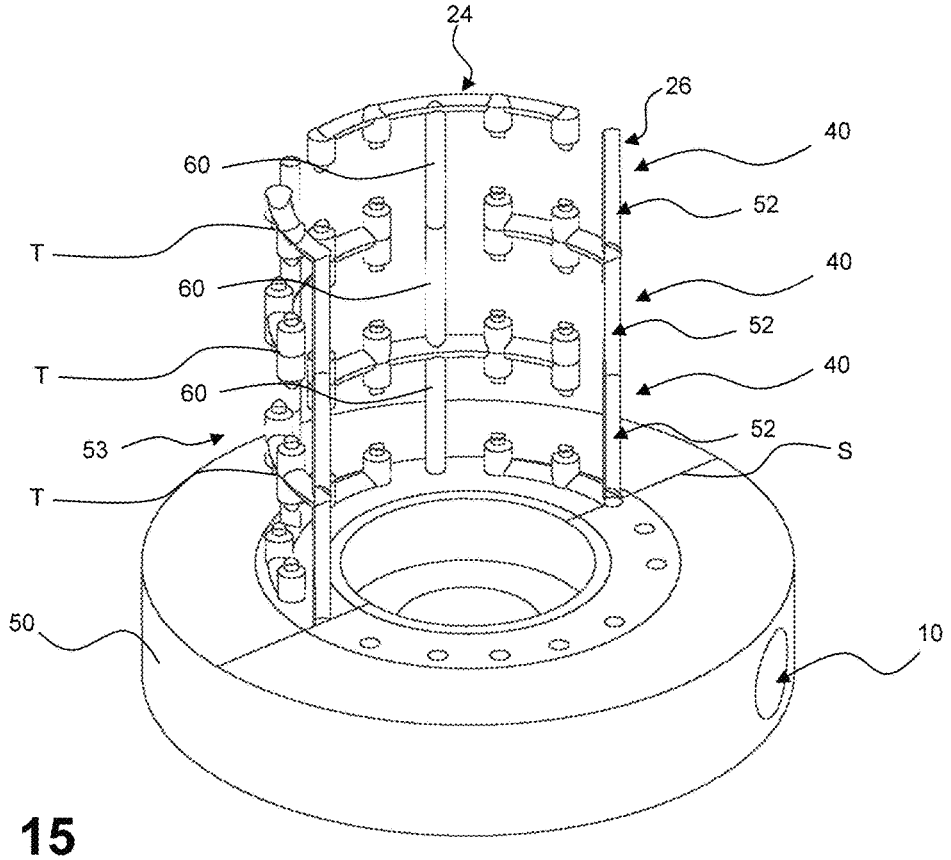
FIG. 15 is a partially sectioned perspective view illustrating the line structures inside the radial piston pump of FIG. 11.

This results, as shown schematically in FIG. 15 for three annular casing blocks 40, in a mirror-symmetrical arrangement of the high-pressure-resistant suction line structure 26 and the high-pressure-resistant pressure line structure 24 with reference to a mirror plane S defined by the pump axis A and a suction riser section 52. Thus, by alternately rotating the individual annular casing blocks 40 180 degrees about a horizontal axis passing through the mirror plane S, any number of annular casing blocks 40 can be modularly combined to increase the maximum achievable volumetric flow rate of the radial piston pump 400. In other words, each sealing plate 51 acts as an additional mirror plane T for the two directly adjacent annular casing blocks 40.

It will be apparent to the skilled person in the field of radial piston pumps that the high-pressure-resistant suction line structure 26 of the radial piston pump 400 according to the fourth embodiment for an annular casing block 40 (see FIG. 14) is not limited to the number of three suction collecting grooves 54, three suction through-holes 56, three pressure collecting grooves 58 and three pressure through-holes 60. Thus, only two or more than three suction collecting grooves 54, suction through-holes 56, pressure collecting grooves 58 and pressure through-holes 60 can be disposed in a casing block 40 in such a way that the mirror symmetry with respect to the mirror plane S is maintained.

As can also be seen in FIG. 16, the sealing plate 51 in this embodiment comprises three partially circumferential collecting recesses 62, three riser recesses 64 and twelve fastening recesses. In the assembled state of the radial piston pump 400, the collecting recesses 62 correspond in each case with the suction collecting grooves 54 or the pressure collecting grooves 58 of the annular casing blocks 40 adjacent to the sealing plate 51. Furthermore, in the assembled state of the radial piston pump 400, the riser recesses 64 correspond in each case with the suction through-holes 56 or the pressure through-holes 60 of the annular casing blocks 40 adjacent to the sealing plate 51. The same applies to the fastening recesses 66. The skilled person will recognize that the recesses in the sealing plate 51 can also be arranged differently in order to correspond with adjacent elements of the radial piston pump 400, such as the annular casing block 40 or any collecting plates present.

As can also be seen in FIG. 16, the sealing plate 51 in this embodiment also has six sealing elements 68, which are disposed in the collecting recesses 62 and the riser recesses 64 in such a way that the sealing plate 51 ensures a fluid-tight connection between each of the two annular casing blocks 40 adjacent to the sealing plate 51. In addition, the sealing plate has a further circumferential sealing element 68 on the inner circumference of the sealing plate 51, which seals a housing chamber 70 of the radial piston pump 400.

The sealing of the individual housing elements of the radial piston pump 400, such as the annular casing blocks 40, with one another and also the sealing of the housing chamber 70 can be achieved by other known sealing means than by the sealing plate 51 discussed here in detail.

Figure 11:
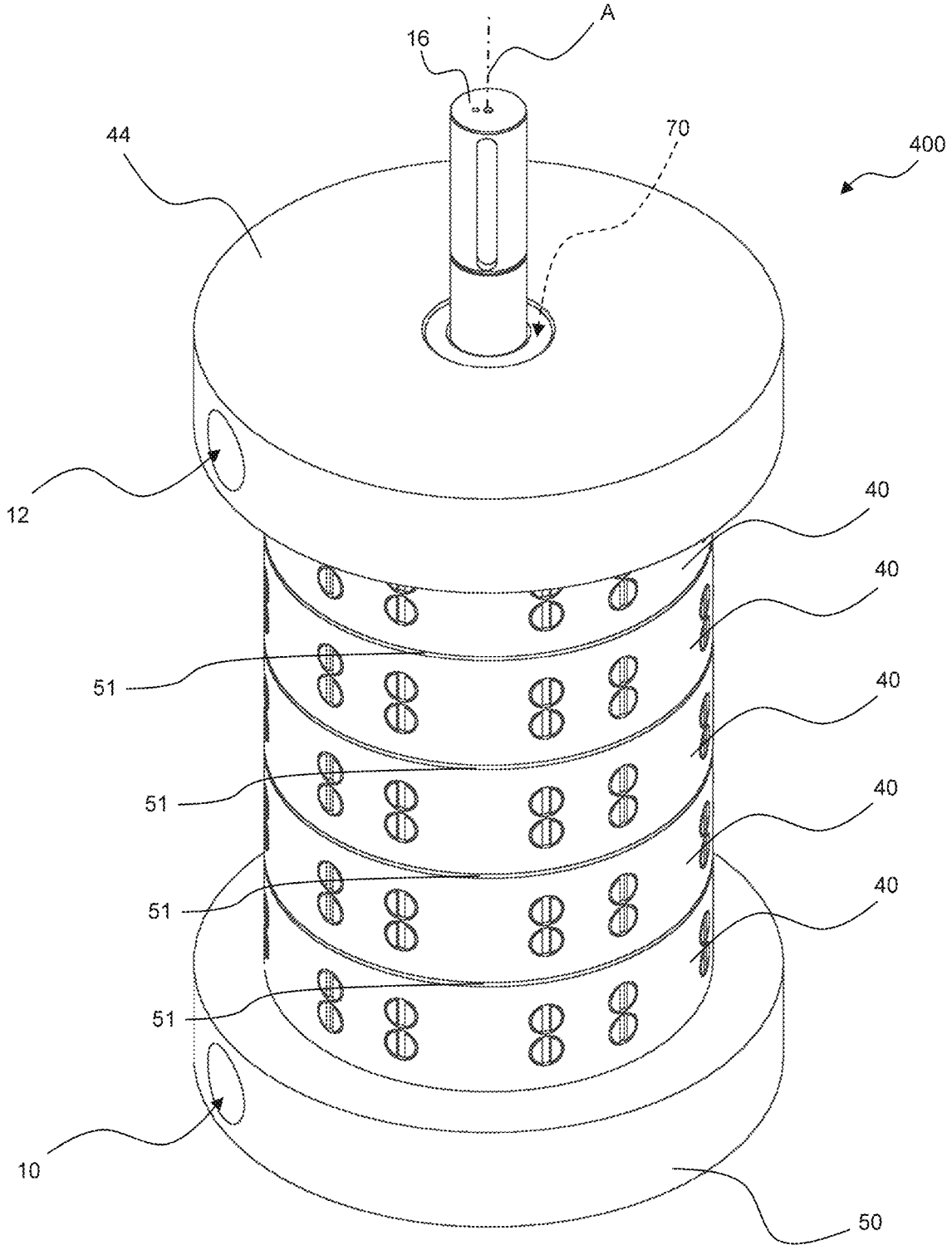
FIG. 11 is a perspective view of a radial piston pump according to the disclosure according to a fourth embodiment.

As can be seen, for example, in FIGS. 11 to 13, the pump shaft 16 of the radial piston pump 400 is disposed in sections in the housing chamber 70 of the radial piston pump 400. The housing chamber 70 is configured to be pressure-tight with respect to the environment and a cleaning fluid, which is different from the fluid to be conveyed by the radial piston pump 400 and is preferably pre-loaded with respect to the ambient pressure, is accommodated in the housing chamber 70. Not shown in FIG. 11 is that the radial piston pump 400 further comprises a cleaning fluid inlet for introducing the cleaning fluid into the housing chamber 70 and a cleaning fluid outlet for discharging the cleaning fluid from the housing chamber 70. The cleaning fluid can be pre-loaded to 2 to 3 bar compared to the ambient pressure, for example. An analogous configuration is also conceivable for the radial piston pumps of the second, third and fourth embodiments.

In a further alternative of the fourth embodiment, the high pressure resistant suction line structure 26 in an annular casing block can also comprise only a suction collecting groove 54, a suction through-hole 56, a pressure collecting groove 58 and a pressure through-hole 60. In this case, corresponding pressure collecting plates 44 and suction collecting plates 50 are disposed between the annular casing blocks 40. For example, in this case, the suction collecting groove 54 can be formed with a first radius on an axial end face of the annular casing block 40 in a completely circumferential manner. In this case, the pressure collecting groove 58 is formed with a second radius on the other axial end face of the annular casing block 40 so that it is completely circumferential. The first radius and the second radius differ from one another. For example, the first radius is smaller than the second radius or vice versa. In this case, a suction through-hole 56 extends from the suction collecting groove 54 parallel to the pump axis A to the other axial end face of the annular casing block 40, on which a suction collecting plate 50 is disposed. A pressure through-hole 60 extends from the pressure collecting groove 58 parallel to the pump axis A to one end face of the annular casing block 40, on which a pressure collecting plate 44 is disposed.

The invention claimed is:

1. A radial piston pump for conveying fluid under high pressure, the radial piston pump comprising:
- a suction port;
- a pressure port;
- a plurality of pump elements;
- a pump shaft which defines a pump axis; and
- an eccentric,
- wherein each pump element comprises at least one suction inlet and at least one pressure outlet, wherein the pump shaft is configured to drive the pump elements via the eccentric in order to convey the fluid under high pressure from the suction port to the pressure port, wherein the radial piston pump comprises a high-pressure-resistant pressure line structure connecting the pressure port to the at least one pressure outlet of each one of the plurality of pump elements, wherein the radial piston pump comprises a high-pressure-resistant suction line structure which connects the suction port to the at least one suction inlet of each one of the plurality of pump elements, wherein the high-pressure-resistant suction line structure comprises at least one suction collecting section and at least one suction riser section, wherein the at least one suction collecting section extends at least partially circumferentially with respect to the pump axis and the at least one suction riser section extends parallel to the pump axis, and wherein the at least one suction riser section is integrated into at least one annular casing block.

2. The radial piston pump according to claim 1, wherein the plurality of pump elements are disposed in at least two axial pump planes which differ from one another in their axial position in relation to the pump axis.

3. The radial piston pump according to claim 1, wherein the high-pressure-resistant suction line structure is at least partially formed by a separate piping arrangement.

4. The radial piston pump according to claim 1, wherein the high-pressure-resistant suction line structure is at least partially integrated into a housing of the radial piston pump.

5. The radial piston pump according to claim 1, wherein each pump element is disposed in a separate housing block.

6. The radial piston pump according to claim 1, wherein the plurality of pump elements are disposed in the at least one annular casing block.

7. The radial piston pump according to claim 1, wherein the at least one suction collecting section is formed by a separate piping arrangement.

8. The radial piston pump according to claim 1, wherein the at least one suction collecting section is formed in at least one separate collecting plate.

9. The radial piston pump according to claim 1, wherein the at least one suction collecting section is integrated into the at least one annular casing block.

10. The radial piston pump according to claim 9, wherein the at least one annular casing block comprises three suction riser sections in the form of suction through-holes and three suction collecting sections in the form of partially circumferential suction collecting grooves, wherein each suction through-hole opens into a suction collecting groove on one side and opens into an axial end face of the annular casing block on the other side.

11. The radial piston pump according to claim 1, wherein a mirror plane is defined by the pump axis and a suction riser section, wherein the high-pressure-resistant suction line structure is mirror-symmetrical to the mirror plane.

12. The radial piston pump according to claim 1, wherein the plurality of pump elements do not comprise return elements.

13. The radial piston pump according claim 1, wherein the pump shaft is disposed at least in sections in a housing chamber of the radial piston pump, wherein the housing chamber is configured to be pressure-tight with respect to an environment and a cleaning fluid, which is different from the fluid to be conveyed and is accommodated in the housing chamber.

* * * * *